United States Patent [19]

Steinberg

[11] Patent Number: 4,814,107

[45] Date of Patent: Mar. 21, 1989

[54] NITROGEN FIREABLE RESISTOR COMPOSITIONS

[75] Inventor: Jerry I. Steinberg, Wilmington, Del.

[73] Assignee: Heraeus Incorporated Cermalloy Division, West Conshohocken, Pa.

[21] Appl. No.: 155,342

[22] Filed: Feb. 12, 1988

[51] Int. Cl.[4] ..... H01B 1/06

[52] U.S. Cl. ..... 252/512; 252/513; 252/518; 252/519; 252/520; 252/521; 501/79; 501/52

[58] Field of Search ..... 252/512, 513, 518, 520, 252/521, 519; 501/79, 49, 52

[56] References Cited

U.S. PATENT DOCUMENTS

| | | | |
|---|---|---|---|
| 4,302,362 | 11/1981 | Hoffman et al. | 252/520 |
| 4,536,328 | 8/1985 | Hankey | 252/518 |
| 4,600,604 | 7/1986 | Scuta | 252/521 |
| 4,606,116 | 8/1986 | Hennings et al. | 252/520 |
| 4,687,597 | 8/1987 | Scuta | 252/512 |

*Primary Examiner*—Josephine Barr

*Attorney, Agent, or Firm*—Sprung Horn Kramer & Woods

[57] ABSTRACT

A nitrogen fireable resistor composition comprising:

a. a conductive phase containing (1) a perovskite of the form $A'_{1-x}A''_xB'_{1-y}B''_yO_3$, wherein when A' is Sr; A'' is one or more of Ba, La, Y, Ca and Na, and when A' is Ba, A'' is one or more of Sr, La, Y, Ca and Na, B' is Ru and B'' is one or more of Ti, Cd, Zr, V and Co, $0<x<0.2$; $0<y<0.2$, (2) 5 to 30 weight % of a metallic copper powder, nickel metallic powder or cupric oxide, relative to the total conductive phase weight, and b. a glass phase selected from the group consisting of (a) 40 to 60 mole % SrO or BaO, 25 to 45 mole % $B_2O_3$, 0 to 6 mole % ZnO, 0.25 to 2.0 mole % $TiO_2$, 2 to 14 mole % $SiO_2$ and (b) 40 to 60 mole % SrO or BaO, 25 to 45 mole % $B_2O_3$, 5 to 20 mole % $Al_2O_3$, 0.25 to 2.0 mole % $TiO_2$.

13 Claims, 1 Drawing Sheet

NITROGEN FIREABLE RESISTOR COMPOSITIONS

BACKGROUND OF THE INVENTION

1. Field of the Invention

The present invention concerns nitrogen fireable resistor compositions.

2. Background Information

U.S. Pat. No. 4,536,328 to Hankey describes a composition for making electrical resistance elements. The entire contents of U.S. Pat. No. 4,536,328 are incorporated by reference herein.

A resistor formulation generally comprises a conductor phase (perovskite), a glass phase (binder component or glass frit), additives and an organic vehicle.

A problem frequently encountered in nitrogen fireable resistors is the interaction at the contact points between the resistor and the metal, e.g., copper, terminals, which leads to an unfavorable aspect ratio.

SUMMARY OF THE INVENTION

It is an object of the invention to provide a thick film resistor which does not have a large contact resistance when terminated with copper conductors, which can lead to poor aspect ratio and therefore poor laser trimming characteristics.

It is a further object of the present invention to provide a thick film resistor which can be fired in a reducing (non-oxidizing) atmosphere such as nitrogen and maintain good properties, such as the thermal coefficient of resistance.

The above objects and other aims and advantages are provided by the present invention which concerns an improved nitrogen fireable resistor composition comprising a conductive phase containing a. a perovskite of the form $A'_{1-x}A''_xB'_{1-y}B''_yO_3$, wherein A' is Sr or Ba, when A' is Sr; A'' is one or more of Ba, La, Y, Ca and Na, and when A' is Ba, A'' is one or more of Sr, La, Y, Ca and Na, B' is Ru and B'' is one or more of Ti, Cd, Zr, V and Co, $O<0.2$; $O<y<0.2$, (2) 5 to 30 weight % of a metallic copper powder, nickel metallic powder or cupric oxide, relative to the total conductive phase weight, and b. a glass phase selected from the group consisting of (a) 40 to 60 mole % SrO or BaO, 25 to 45 mole % $B_2O_3$, 0 to 6 mole % ZnO, 0.25 to 2.0 mole % $TiO_2$, 2 to 14 mole % $SiO_2$ and (b) 40 to 60 mole % SrO or BaO, 25 to 45 mole % $B_2O_3$, 5 to 20 mole % $Al_2O_3$, 0.25 to 2.0 mole % $TiO_2$.

DETAILED DESCRIPTION OF THE INVENTION

Figure 1:
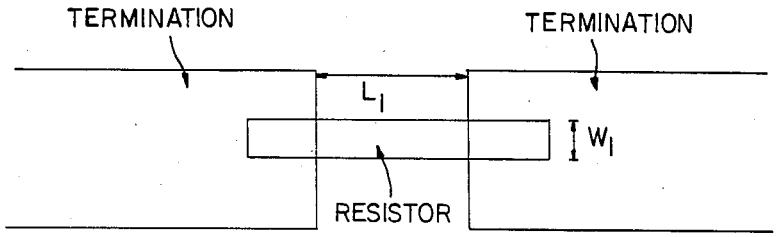
FIG. 1 is a schematic diagram of a resistor.

The key materials included in the thick film resistor composition of the invention are the (a) conductive phase and (b) glass frit (glass phase or binder).

Additives may be included to optimize various properties of the resistors such as thermal coefficient of resistance, electrostatic discharge sensitivity, power handling and laser trimmability. These additives include, but are not limited to, $MnO_2$, $TiO_2$, $ZrO_2$, CuO and $SrTiO_3$. Other additives can act as surface modifiers to improve cosmetic appearances and as glass strengtheners. These modify the flow of glass during firing and also provide sites to stop crack projection and therefore improve laser trim stability. Typically these additives are high surface area ceramic oxides such as $Al_2O_3$, $TiO_2$ and $SiO_2$.

All of the above are dispersed in an organic vehicle. The main purpose of the vehicle is to act as a medium for transfer of the dispersed particles onto an appropriate substrate. The vehicle also must clearly volatilize during firing of the resistor ink and have a minimal effect such as reduction of the conductive phase.

A suitable organic vehicle for use in the present invention would be an organic vehicle which volatilizes at a fairly low temperature (200° to 500° C.). An organic vehicle for use in the present invention is preferably a resin, e.g., an acrylic ester resin, preferably isobutyl methacrylate and a solvent such as "TEXANOL" of Eastman Kodak, Rochester, N.Y., U.S.A. The resin can be any polymer which decomposes at or below 400° C. in a nitrogen atmosphere containing less than 10 ppm oxygen.

Other solvents that can be employed are terpineol or tridecyl alcohol ("TDA"). The solvent, for utilization in the present invention, can be any solvent or plasticizer which dissolves the respective resin and which exhibits a suitable vapor pressure consistent with subsequent dispersion and transfer processes. In a preferred embodiment, the organic vehicle is 30 to 50 weight percent isobutyl methacrylate and 50 to 70 weight percent "TEXANOL".

Preferred combinations for the perovskite are $SrRuO_3$, $Sr_{0.9}La_{0.1}RuO_3$, $SrRu_{0.95}Ti_{0.05}O_3$, $Sr_{0.9}La_{0.1}Ru_{0.95}Ti_{0.05}O_3$, $BaRuO_3$, $Ba_{0.9}La_{0.1}RuO_3$, $BaRu_{0.95}Ti_{0.05}O_3$ and $Ba_{0.9}La_{0.1}Ru_{0.95}Ti_{0.05}O_3$.

Although the properties described herein are not necessarily dependent on the physical characteristics of the perovskite conductive phase, it is preferred that all particles be of small enough size to pass through a 400 mesh screen and that the surface area be between 3 and 9 $m^2/g$ measured by a B.E.T. Monosorb. B.E.T. Monosorb is a method of measuring surface area of a powder. It involves determining the volume of gas necessary to coat the powder with a monolayer of the adsorbed gas and from the molecular diameter the surface area is calculated.

Addition of copper or nickel metal (elemental copper or elemental nickel) or cupric oxide as part of the conductive phase yields formulations with good aspect ratio. Aspect ratio is related to scaling of resistance values with respect to resistor size. For example, ideally as a thick film resistor increases in length fivefold, while the width remains constant, the resistance should also increase five times. A deviation from the rule for a thick film resistor indicates a chemical reaction occuring at the interface between the resistor and the terminating conductor, causing a contact resistance in series with the resistor body (see FIG. 1 and FIG. 2).

Figure 2:
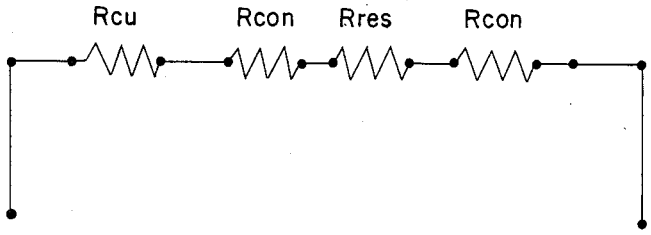
FIG. 2 is a schematic diagram of an equivalent electrical resistance circuit of FIG. 1.

FIG. 2 depicts the equivalent electrical circuit of FIG. 1. If an ohmmeter was placed in the terminations of FIG. 1, the resistance it would measure would be that of the copper terminations ($R_{CU}$), the contact resistance at the interface between the termination and resistor ($R_{CONT}$) and the resistance of the resistor body ($R_{RES}$). These resistances are all in series as indicated by the circuit and therefore are additive, $R_{EQ}=R_{CU}+2(-$ $R_{CONT}$)+$R_{RES}$, where $R_{EQ}$ is the equivalent resistance as would be measured by an ohmmeter.

Copper or nickel metal or cupric oxide powder as a constituent of the conductive phase results in good aspect ratios (greater than a 4.5 increase in resistance for a fivefold increase in resistor length). Without wishing to be bound by any particular theory of operability, the copper or nickel metal or cupric oxide powder is believed to control the decomposition and dissolution of the ruthenium perovskite. During firing in a reducing atmosphere there is a tendency for polymer to reduce the perovskite by the following reaction:

(a) $SrRuO_3$+Carbon (polymer)→$RuO_2$+SrO (1)

(b) $RuO_2$→Ru+$O_2$(in reducing atmospheres)

Also there is a tendency for the glass to dissolve the perovskite according to the following reaction:

(a) $SrRuO_3$+Glass→$RuO_2$+SrO (2)

(b) $RuO_2$→Ru+$O_2$(in reducing atmospheres)

If either reaction (1) or (2) occurs with a large amount of $RuO_2$ or ruthenium being produced, resistors with poor aspect ratio will be produced. Alternatively by preventing these reactions, poor contact resistance also occurs. Addition of copper or nickel metal or cupric oxide powder results in a compromise between these two extremes and good aspect ratios.

Although the physical properties of the copper or nickel metal or cupric oxide powder are not critical for the improved aspect ratio it is preferred that the copper or nickel metal or cupric oxide powder have a 50% particle size (sedigraph) in the range of 2 to 7.0 microns and a surface area of 0.25 to 3.0 $m^2/g$.

The amount of copper or nickel metal powder or curpic oxide relative to the total conductive phase weight is from 5 to 30 weight %, preferably 8 to 20 weight %. With copper or nickel metal powder or cupric oxide powder below this amount, the variation in resistor properties from circuit to circuit is variable. Above this range, the Thermal Coefficient of Resistance (TCR) varies with temperature and becomes outside the range useful for thick film applications (400 ppm). TCR is defined by the following formula:

$$TCR = \frac{R_{T2} - R_{T1}}{R_{T1(T2-T1)}} \quad (3)$$

where $R_{T2}$ is the resistance at temperature $T_2$ and $R_{T1}$ is the resistance at temperature $T_1$. When $T_2$=125° C. and T1=25° C., this value is referred to as HTCR.

The glass frit is important in general in that it helps sinter the conductive phase particles into a dense homogeneous film and forms a chemical bond for adherence to a substrate. The glass frit also serves to dilute the conductive phase and therefore results in resistors with varying resistivity.

For the specific resistors described herein, the type of glass formulation is important in that it helps control reaction (2). It was found that in order to prevent complete dissolution of the conductive phase at least 40 mole % of the cation included on the A' site be in the glass. For the cases described herein this is SrO and/or BaO. The preferred amount is between 47 to 58 mole %. With larger amounts, the glasses tend to devitrify and to have poor adhesion to the substrate. Also the glass should preferably include $TiO_2$ as a modifier in the amounts of 0.25 to 2.00 mole %, with a preferred range of 0.7 to 1.5 mole %. Other modifiers to adjust other properties of the resistors can include $Al_2O_3$, $MnO_2$, PbO, $ZrO_2$, CuO, CaO, ZnO, $Bi_2O_3$, CdO and $Na_2O$. The glass forming oxides can either be $B_2O_3$ or $SiO_2$.

It is preferred that the glass be of one or two families of glass, namely SrO—$B_2O_3$—$SiO_2$ or BaO—$B_2O_3$—$SiO_2$, modified with ZnO and $TiO_2$ (Glass Family I) and SrO—$B_2O_3$—$Al_2O_3$ or BaO—$B_2O_3$—$Al_2O_3$, modified with $TiO_2$ (Glass Family II). The preferred composition ranges for these glass families are as follows:

| | Preferred mole % |
|---|---|
| Glass Family I | |
| SrO or BaO | 42 to 52 |
| $B_2O_3$ | 28 to 40 |
| ZnO | 2 to 5 |
| $TiO_2$ | 0.7 to 1.5 |
| $SiO_2$ | 7 to 12 |
| Glass Family II | |
| SrO or BaO | 45 to 58 |
| $B_2O_3$ | 28 to 40 |
| $Al_2O_3$ | 8 to 18 |
| $TiO_2$ | 0.7 to 1.5. |

In the glass families described herein the SrO component can be SrO, BaO or SrO+BaO.

The physical properties of the glass powder are not critical for the improvement of the aspect ratio. However, typical surface areas (BET monosorb) are between 0.5 and 3.0 $m^2/g$.

This invention will now be described with reference to the following non limiting examples.

EXAMPLES

Example 1

Preparation of Perovskite

The perovskite powder was prepared by mixing the appropriate powders for four hours in a ball mill in deionized water. The dried powders were then calcined in an alumina crucible at 1200° C. for 2 hours. After sieving through a 200 mesh screen there was a second calcining at 1200° C. for two hours followed by ball milling in deionized water for appropriate size reduction.

Example 2

Preparation of Glass

The glass was prepared by weighing the appropriate oxides into a kyanite crucible. The powders were preheated at 600° C. for one hour and then melted at 1200° C. for 30 minutes. The molten material was then quenched into water at room temperature. This facilitated glass formation and subsequent size reduction. Typically the appropriate size powder was obtained by ball milling in isopropyl alcohol.

Example 3

Preparation of Paste and Screen Printing

To produce a paste the powders were first kneaded, either by hand or by an electric Hobart mixer, and then dispersed by use of a muller or three roll mill. The resulting ink was screen printed through a 325 mesh screen onto a substrate, typically 96% alumina, which had already had the appropriate termination, typically copper, prefired on it. The resistors were then dried at 150° C. for 10 minutes to remove volatile solvents.

Table 4 shows that the glass composition should preferably contain titanium oxides for good aspect ratio and HTCR with acceptable values.

TABLE 1(1)

| | I | II | III | IV | V | VI |
|---|---|---|---|---|---|---|
| $SrRuO_3$ | — | — | — | — | — | 35.0 |
| $Sr_{.9}La_{.1}RuO_3$ | — | — | — | 35.0 | 35.0 | — |
| $SrRu_{.95}Ti_{.05}O_3$ | 31.5 | 35.0 | 31.5 | — | — | — |
| Glass A | 38.5 | — | — | — | — | — |
| Glass B | — | 35.0 | — | — | 35.0 | 35.0 |
| Glass C | — | — | 38.5 | — | — | — |
| Glass D | — | — | — | 35.0 | — | — |
| Vehicle | 30.0 | 30.0 | 30.0 | 30.0 | 30.0 | 30.0 |
| Resistance | 69.3KΩ | 1340KΩ | 112.3KΩ | 5.6KΩ | 324KΩ | 15KΩ |
| HTCR | 18.6 | −268 | — | 23 | — | — |
| Aspect Ratio | 1.4/1 | 3.1/1 | 0.88/1 | 1.1/1 | 1.86/1 | 3.1/1 |

Mole %
*Glass A: 47.5 SrO, 38.3 $B_2O_3$, 10.4 $SiO_2$, 3.8 ZnO
**Glass B: 46.5 SrO, 38.3 $B_2O_3$, 10.4 $SiO_2$, 3.8 ZnO, 1.0 $TiO_2$
***Glass C: 55.0 SrO, 30.0 $B_2O_3$, 15.0 $Al_2O_3$
****Glass D: 54.0 SrO, 30.0 $B_2O_3$, 15.0 $Al_2O_3$, 1.0 $TiO_2$
(1)all compositions are in weight percent

Example 4

Firing and Testing of Resistors

The dried resistors were then fired in a thick film belt furnace with a reducing atmosphere, typically nitrogen with less than 10 ppm oxygen with a peak temperature of 900° C.±10° C. The fired circuits were then measured for the relevant properties. The resistance was determined by a two point probe method utilizing a suitable ohmmeter. The temperature coefficient of resistance was found by first measuring the resistance at 25° C. and then putting the circuit into an appropriate test chamber at 125° C. and remeasuring the resistance and calculating according to equation (3). The aspect ratio was determined by measuring the resistance of a resistor of size ($R_1$) 50 mm×50 mm and then a resistor of size ($R_5$) 50 mm×250 mm. The latter was divided by the former ($R_5/R_1$): theoretically the result should be 5. It was found that if the value was greater than about 4.5, suitable resistors for thick film circuits could be provided. Values less than 4.5 could not be laser trimmed to an appropriate value. Laser trimming is a production method whereby a fired resistor is cut into with a laser beam, resistor material is vaporized and the value of the resistance increases to a predetermined value.

For appropriate resistors suitable for thick film circuits, other properties are needed. These properties tend to be specific to particular applications and therefore are not reported here. These include power handling, voltage stability, electrostatic discharge sensitivity, environmental stability and blendability.

Table 1 shows that without copper present, combinations of three different pervoskites and three different glasses from two different glass families (SrO—$B_2O_3$—$SiO_2$ or BaO—$B_2O_3$—$SiO_2$, modified with ZnO and $TiO_2$) and (SrO—$B_2O_3$—$Al_2O_3$ or BaO—$B_2O_3$—$SiO_2$, modified with $TiO_2$) result in poor aspect ratios.

Table 2 establishes that the addition of copper powder to perovskite/glass combinations yields compostions with good aspect ratios. Nickel metal powder substituted for copper (Example X) gave acceptable results.

Table 3 demonstrates the limits of copper powder addition for a given glass formulation. At about the 21% level, HTCR becomes higher than 400 ppm, which is for most applications the maximum useable level.

TABLE 2(1)

| | VIII | IX | X | XII |
|---|---|---|---|---|
| $SrRuO_3$ | — | — | — | — |
| $Sr_{.9}La_{.1}RuO_3$ | — | 37.8 | — | — |
| $SrRu_{.95}Ti_{.05}O_3$ | 31.5 | — | 31.5 | 31.5 |
| Glass B | 31.5 | 25.2 | | 31.5 |
| Glass D | — | — | 31.5 | — |
| CuO | — | — | — | — |
| Copper | 7.0 | 7.0 | 7.0 | — |
| Nickel | — | — | — | 7.0 |
| Vehicle | 30.0 | 30.0 | 30.0 | 30.0 |
| Resistance | 65.KΩ | 1.4KΩ | 11.8KΩ | 576KΩ |
| HTCR | 267 | 477 | 76 | 102 |
| Aspect Ratio | 7.9/1 | 6.1/1 | 6.1/1 | 5.3/1 |

Mole %
*Glass B: 46.5 SrO, 38.3 $B_2O_3$, 10.4 $SiO_2$, 3.8 ZnO, 1.0 $TiO_2$
**Glass D: 54.0 SrO, 30.0 $B_2O_3$, 15.0 $Al_2O_3$, 1.0 $TiO_2$
(1)all compositions are in weight percent

TABLE 3(1)

| | XIII | XIV | XV | XVI |
|---|---|---|---|---|
| $SrRu_{.95}Ti_{.05}O_3$ | 33.3 | 31.5 | 30.8 | 29.8 |
| Glass D | 33.3 | 31.5 | 30.8 | 29.8 |
| Copper | 3.6 | 7.0 | 8.3 | 10.5 |
| Vehicle | 30.0 | 30.0 | 30.0 | 30.0 |
| Copper, Wt. % of total conductive phase | 9.75 | 18.2 | 21.2 | 26.0 |
| Resistance | 14.9KΩ | 12.1KΩ | 7.9KΩ | 8.2KΩ |
| HTCR | 140 | 228 | 415 | 410 |
| Aspect Ratio | 5.6/1 | 4.6/1 | 5.6/1 | 4.5/1 |

Mole %
*Glass D: 54.0 SrO, 30.0 $B_2O_3$, 15.0 $Al_2O_3$, 1 $TiO_2$
(1)all compositions are in weight percent

TABLE 4(1)

| | XVII | XVIII | XIX | XX | XXI |
|---|---|---|---|---|---|
| $Sr_{.9}La_{.1}RuO_3$ | 31.5 | 31.5 | 31.5 | 31.5 | 31.5 |
| Glass C | 31.5 | — | — | — | — |
| Glass E | — | 31.5 | — | — | — |
| Glass F | — | — | 31.5 | — | — |
| Glass G | — | — | — | 31.5 | — |
| Glass H | — | — | — | — | 31.5 |
| Copper | 7.0 | 7.0 | 7.0 | 7.0 | 7.0 |
| Vehicle | 30.0 | 30.0 | 30.0 | 30.0 | 30.0 |
| Resistance | 520KΩ | 64KΩ | 1900KΩ | 48KΩ | 6KΩ |
| HTCR, ppM | −9800 | 1654 | 8906 | 2118 | 206 |
| Aspect Ratio | 0.51/1 | 5/1 | 1.4/1 | 6/1 | 6/1 |

| | Mole % | | | |
|---|---|---|---|---|
| | SrO | $B_2O_3$ | $Al_2O_3$ | $TiO_2$ |
| *Glass C: | 55 | 30 | 15 | — |
| **Glass E: | 50 | 40 | 10 | — |
| ***Glass F: | 45 | 30 | 25 | — |

TABLE 4[1]-*continued*

| | | | | |
|---|---|---|---|---|
| ****Glass G: | 40 | 50 | 10 | — |
| *****Glass H | 50 | 32 | 17 | 1.0 |

[1]all compositions are in weight percent

Example 5

This Example, summarized in Table 5 below, demonstrates the utilization of Cu (A), CuO (B) and $Cu_2O$ (C) in the present invention.

TABLE 5

| | A | B | C |
|---|---|---|---|
| *$Sr_{.9}La_{.1}RuO_3$ | 31.8 | 31.8 | 31.8 |
| *Glass | 31.8 | 31.8 | 31.8 |
| *Cu | 7.0 | — | — |
| *CuO | 0 | 7.0 | — |
| *$Cu_2O$ | — | — | 7.0 |
| *Vehicle | 30.0 | 30.0 | 30.0 |
| Resistance | 6KΩ | 11KΩ | 6KΩ |
| HTCR | 212 | 160 | 78 |
| Aspect Ratio | 6.5/1 | 5.8/1 | 0.91/1 |

*WEIGHT PERCENT
Glass composition:
50 mole % SrO
33 mole % $B_2O_3$
16 mole % $Al_2O_3$
1 mole % $TiO_2$ It will be appreciated that the instant specification and claims are set forth by way of illustration and not limitation, and that various modifications and changes may be made without departing from the spirit and scope of the present invention.

What is claimed is:

1. A nitrogen fireable resistor composition comprising:

a. a conductive phase containing (1) a perovskite of the form $A'_{1-x}A''_xB'_{1-y}B''_yO_3$, wherein A' is Sr or Ba, when A' is Sr; A'' is one or more of Ba, La, Y, Ca and Na, and when A' is Ba, A'' is one or more of Sr, La, Y, Ca and Na, B' is Ru and B'' is one or more of Ti, Cd, Zr, V and Co, $O<x<0.2$; $O<y<0.2$, (2) 5 to 30 weight % of a metallic copper powder, nickel metallic powder or cupric oxide, relative to the total conductive phase weight, and b. a glass phase selected from the group consisting of (a) 40 to 60 mole % SrO or BaO, 25 to 45 mole % $B_2O_3$, 0 to 6 mole % ZnO, 0.25 to 2.0 mole % $TiO_2$, and 2 to 14 mole % $SiO_2$ and (b) 40 to 60 mole % SrO or BaO, 25 to 45 mole % $B_2O_3$, 5 to 20 mole % $Al_2O_3$, and 0.25 to 2.0 mole % $TiO_2$.

2. A nitrogen fireable resistor composition according to claim 1, wherein A' is Sr.

3. A nitrogen fireable resistor composition according to claim 1, wherein A' is Ba.

4. A nitrogen fireable resistor composition according to claim 1, wherein the perovskite is selected from the group consisting of $SrRuO_3$, $SrRu_{0.8}Ti_{0.2}O_3$, $SrRu_{0.9}Ti_{0.1}O_3$, $Sr_{0.1}RuO_3$, $SrRu_{0.95}Ti_{0.05}O_3$, $Sr_{0.9}La_{0.1}Ru_{0.95}Ti_{0.05}O_3$, $SrRu_{0.095}Cd_{0.05}O_3$, $Sr_{0.09}Ba_{0.1}RuO_3$, $Sr_{0.9}Y_{0.1}RuO_3$, $Sr_{0.8}Na_{0.1}La_{0.1}RuO_3$, $SrRu_{0.8}Zr_{0.2}O_3$, $SrRu_{0.9}Zr_{0.1}O_3$, $SrRu_{0.75}V_{0.25}O_3$, $SrRu_{0.8}Co_{0.2}O_3$, $SrRu_{0.8}Ti_{0.1}Zr_{0.1}O_3$, $BaRuO_3$, $Ba_{0.9}La_{0.1}RuO_3$, $BaRu_{0.95}Ti_{0.05}O_3$ and $Ba_{0.9}La_{0.1}Ru_{0.95}Ti_{0.05}O_3$.

5. A nitrogen fireable resistor composition according to claim 1, wherein the perovskite is selected from the group consisting of $SrRuO_3$, $Sr_{0.9}La_{0.1}RuO_3$, $SrRu_{0.95}Ti_{0.05}O_3$, $Sr_{0.9}La_{0.1}Ru_{0.95}Ti_{0.05}O_3$, $BaRuO_3$, $Ba_{0.9}La_{0.1}RuO_3$, $BaRu_{0.95}Ti_{0.95}O_3$ and $Ba_{0.9}La_{0.1}Ru_{0.95}Ti_{0.05}O_3$.

6. A nitrogen fireable resistor composition according to claim 1, further comprising an organic vehicle.

7. A nitrogen fireable resistor composition according to claim 6, wherein the organic vehicle is a mixture of an acrylic ester resin and a solvent.

8. A nitrogen fireable resistor composition according to claim 7, wherein the resin is isobutyl methacrylate.

9. A nitrogen fireable resistor composition according to claim 1, wherein the metallic powder or cupric oxide has a 50% particle size in the range of 2 to 7.0 microns and a surface area of 0.25 to 3.0 $m^2/g$.

10. A nitrogen fireable resistor composition according to claim 1, wherein the amount of metallic powder or cupric oxide relative to total conductive phase is 8 to weight %.

11. A nitrogen fireable resistor composition according to claim 1, wherein the glass phase has the following composition in mole %:

42 to 52 SrO or BaO
28 to 40 $B_2O_3$
2 to 5 ZnO
0.7 to 1.5 $TiO_2$
7 to 12 SiO .

12. A nitrogen firing resistor composition according to claim 1, wherein the glass phase has the following composition in mole %:

45 to 58 SrO or BaO
28 to 40 $B_2O_3$
8 to 18 $Al_2O_3$
0.7 to 1.5 $TiO_2$.

13. A nitrogen fireable resistor composition according to claim 1, further comprising one or more additives selected from the group consisting of $MnO_2$, $TiO_2$, $ZrO_2$, CuO and $SrTiO_3$.

* * * * *

UNITED STATES PATENT AND TRADEMARK OFFICE

CERTIFICATE OF CORRECTION

PATENT NO. : 4,814,107

DATED : March 21, 1989

INVENTOR(S) : Jerry I. Steinberg

It is certified that error appears in the above-identified patent and that said Letters Patent is hereby corrected as shown below:

| | |
|---|---|
| Abstract, line 7, Col. 1, line 42 and Col. 7, line 43-44 | Delete "$0 < x < 0.2$; $0 < y < 0.2$" and substitute --$0 \leq x < 0.2$; $0 \leq y \leq 0.2$-- |

Signed and Sealed this

Thirty-first Day of October, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,814,107

DATED : March 21, 1989

INVENTOR(S) : Jerry I. Steinberg

It is certified that error appears in the above-identified patent and that said Letters Patent is hereby corrected as shown below:

| | |
|---|---|
| Abstract, line 7, Col. 1, line 42 and Col. 7, line 43-44 | Delete "$0 < x < 0.2$; $0 < y < 0.2$" and substitute --$0 \leq x \leq 0.2$; $0 \leq y \leq 0.2$-- |
| Title Page, under "U.S. Patent Documents, line 3 | Delete "Scuta" and substitute --Siuta-- |
| Col. 2, line 57 | Correct --occurring-- |
| Col. 8, line 8 | Delete "$Sr_{0.1}RuO_3$" and substitute --$Sr_{0.9}RuO_3$-- |
| Col. 8, line 33 | Before "weight %" insert --20-- |

This certificate supersedes Certificate of Correction issued October 31, 1989.

Signed and Sealed this

Sixth Day of March, 1990

*Attest:*

*Attesting Officer*

JEFFREY M. SAMUELS

*Acting Commissioner of Patents and Trademarks*